US006951352B1

(12) United States Patent
Hyde

(10) Patent No.: US 6,951,352 B1
(45) Date of Patent: Oct. 4, 2005

(54) FLAP BOARD BOOK CONSTRUCTION

(75) Inventor: Andrew M. Hyde, Nashville, TN (US)

(73) Assignee: The Clever Factory, Inc., Nashville, TN (US)

( * ) Notice: Subject to any disclaimer, the term of this patent is extended or adjusted under 35 U.S.C. 154(b) by 49 days.

(21) Appl. No.: 10/632,315

(22) Filed: Aug. 1, 2003

(51) Int. Cl.[7] ..... B42D 1/00

(52) U.S. Cl. ..... 281/38; 281/3.1; 281/15.1; 446/147; 446/151

(58) Field of Search ..... 281/2, 3.1, 5, 15.1, 281/36–38, 51; 446/147–152

(56) References Cited

U.S. PATENT DOCUMENTS

| | | | | |
|---|---|---|---|---|
| 4,103,444 A | * | 8/1978 | Jones et al. | 40/124.08 |
| 4,487,590 A | | 12/1984 | Becker et al. | |
| 4,597,743 A | | 7/1986 | Becker et al. | |
| 4,877,269 A | | 10/1989 | Callaghan et al. | |
| 4,932,679 A | | 6/1990 | Mayer et al. | |
| 5,022,681 A | * | 6/1991 | Penick | 281/15.1 |
| 5,257,823 A | * | 11/1993 | Colvin et al. | 283/117 |
| 5,328,206 A | | 7/1994 | Scott | |
| 5,472,240 A | * | 12/1995 | Davies | 283/116 |
| 5,943,800 A | * | 8/1999 | Rose | 40/124.08 |
| 6,276,887 B1 | | 8/2001 | Hughes | |
| 6,279,956 B1 | | 8/2001 | Kaufman | |
| 6,450,535 B1 | * | 9/2002 | Shafer | 281/38 |
| 6,508,488 B1 | * | 1/2003 | Becker | 281/38 |
| 2004/0012190 A1 | * | 1/2004 | D'Andrea | 281/38 |

FOREIGN PATENT DOCUMENTS

EP 920893 * 6/1999

* cited by examiner

*Primary Examiner*—Monica S. Carter
(74) *Attorney, Agent, or Firm*—Waddey & Patterson, P.C.; Phillip E. Walker

(57) ABSTRACT

Included is a flap board book having at least one page constructed of a first piece of grayback board and a second piece of grayback board wherein each piece of grayback board has a front and a back side. Each front side includes a coating adapted to accept printing. The first piece of grayback board includes a rotateably attached section positioned to allow viewing of a portion of the backside of the first piece of the grayback board and a portion of the backside of the second piece of grayback board. The portion of the backside of the first piece of the grayback board and the portion of the backside of the second piece of the grayback board includes a flashing adapted to accept printing ink. In this invention, only the portion of the back of each grayback board piece has been flashed, or treated. This treatment enables these portions, and only these portions on the flashed side of each piece, to properly accept printing ink.

21 Claims, 3 Drawing Sheets

FLAP BOARD BOOK CONSTRUCTION

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

BACKGROUND OF THE INVENTION

The present invention relates generally to the composition of books, and more specifically to the construction of lift-the-flap board books and the four color printing of such books.

Standard "board books" are composed of multiple "leaves", or pages. A single leaf is comprised of two pages front and back. Each leaf is formed by gluing two pieces of "board" together. The board is either a gray or white board, and typically weighs between 350 and 500 grams per square meter. The white board, also known as art board, is paperboard made with expensive, bleached wood or other fibers. White board is completely coated on at least one side. However, the uncoated side can be printed on due to the high quality of the expensive bleached fibers used to make the white board and the fact that the white color more readily accepts other colors of ink. Grayback board is paperboard made with cheaper, non-bleached wood, or other fibers. Grayback board is usually coated only on one side which allows accurate and effective printing on that one coated side. However, the uncoated side does not readily accept ink and cannot be printed upon due to the rough surface and gray color which obscures and masks the traditional four color printing process.

For standard board books, only the coated side of the white board or grayback board has been printed on. An improvement of the standard board book is called a "lift-the-flap", "lift-a-flap", or just "flap book". The flap book has been developed and used extensively by multiple publishers in the last few decades. This improved board book is especially geared toward children and facilitates their learning process by more effectively posing a test/question/picture to the child and then revealing the answer under the flap. This product format is particularly useful for developing important skills such as opposites, colors, numbers, math, and peek-a-boo concepts.

The flap book utilizes the same general construction as a standard book board with a few changes. There are two ways to make a flap book. The first is to make three sided die cuts into one of the two pieces of the board that are glued together. This cut creates the flap and allows the flap to be lifted by the reader. The other convention method of making a flap book creates what is called a "paste-on lift-a-flap book." For this paste-on flap book, the product is constructed by pasting multiple pieces of white paper board that is coated on both sides onto the leaves of a standard board book. These pasted-on flaps are flaps that have been entirely coated on both sides and stand out and are spaced from the individual leaves or pages of the board book. This requires extensive handwork used to apply the paste-on flaps onto the leaves and the paste-on flaps are less durable than under the traditional die cut flap book.

Conventionally, there are two ways to create the die cut, or flush setting, flap books. The first is to print the books on expensive white board. This requires purchasing white board that is coated on at least one if not both sides. This type of white board is expensive and not necessarily cost effective. The second conventional way to create a flush flap board book is to print the book on grayback board that has been completely coated on both sides. This is more expensive than the grayback paper that has only been coated on one side, but less expensive than the white board paper that has been coated on one side. However, this paper type is not commonly stocked by most paper factories and has a limited use. Therefore, only rarely is the flap board book made with grayback board that has been completely coated on both sides.

What is needed then is a flap board book that is cheaper to make than conventional flush flap board books but yet more durable than the paste on lift-a-flap board books.

SUMMARY OF THE INVENTION

The present invention includes a flap board book comprising at least one page constructed of a first piece of grayback board and a second piece of grayback board wherein each piece of grayback board has a front and a back side. Each front side includes a coating adapted to accept printing. The first piece of grayback board includes a rotateably attached section positioned to allow viewing of a portion of the backside of the first piece of the grayback board and a portion of the backside of the second piece of grayback board. The portion of the backside of the first piece of the grayback board and the portion of the backside of the second piece of the grayback board includes a flashing adapted to accept printing ink. In this invention, only the portion of the back of each grayback board piece has been flashed, or treated. This treatment enables these portions, and only these portions on the flashed side of each piece, to properly accept printing ink.

Also included is a method of creating a page for a lift-a-flap book. The method comprises providing grayback board coated on a first side and flashing a portion of a second side of the grayback board. Included is applying printed matter to the first side and the flashed portion of the second side. Finally, a selective viewing area is assembled and aligned with the flash portion of the second side. Also included is attaching a second piece of grayback board to the second side of the first piece of grayback board. The second piece of grayback board has a first side that is coated and has a portion of its second side that has been a flashed. The flashed portion is aligned with the flashing of the first side of the first piece of grayback board.

Therefore, it is an object of the present invention to provide a lift-a-flap board book.

It is another object of the present invention to provide such a lift-a-flap board book at a less expensive price that is conventionally available while still maintaining the quality of the book.

It is still another object of the present invention to provide a flap board book having only a portion of the backs of the individual pages of the book treated to allow four color printing on those portions.

Other further objects, features, and advantages of the present invention will be readily apparent to those skilled in the art upon a reading of the following disclosure when taken in conjunction with the accompanying drawings.

BRIEF DESCRIPTION OF THE DRAWINGS

FIG. 1B shows the flap partially opened.

FIG. 1C shows the flap fully open.

FIG. 2B shows the treated or flashed portion of the back of the grayback board corresponding to the location of the flap.

FIG. 3B shows the treated location that will physically correspond to the flap shown FIGS. 2A–2B.

FIG. 4 shows how the treated locations on the back of each grayback board piece will align and allow viewing of four-color printing located there.

DESCRIPTION OF THE PREFERRED EMBODIMENTS

Figure 1C:
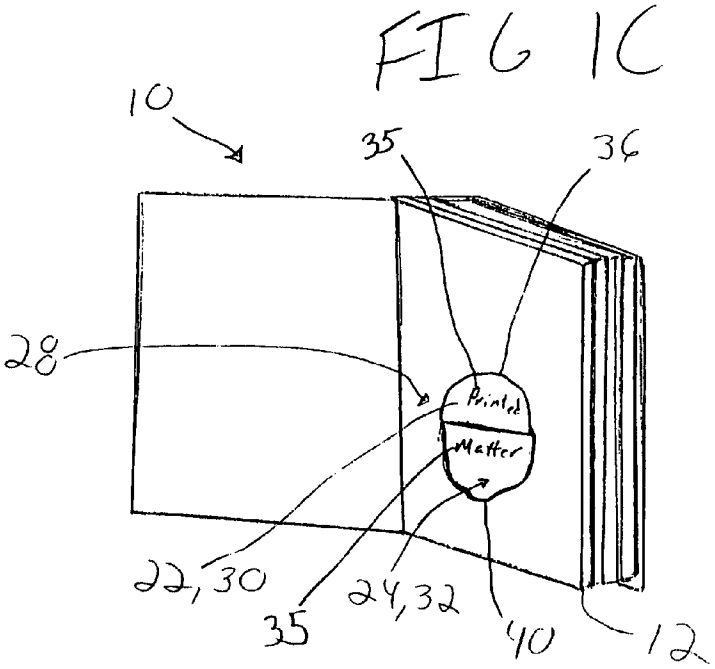
FIG. 1C is a perspective view similar to FIGS. 1A and 1B.
Figure 1B:
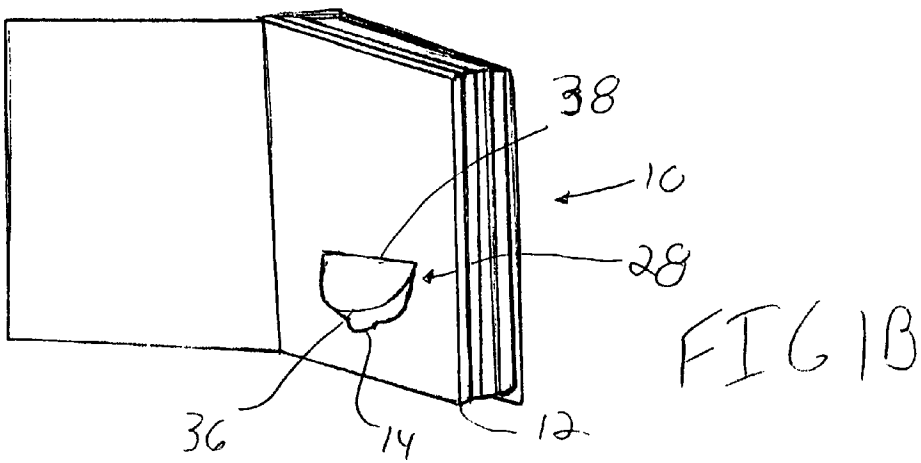
FIG. 1B is a perspective view similar to FIG. 1A.
Figure 1A:
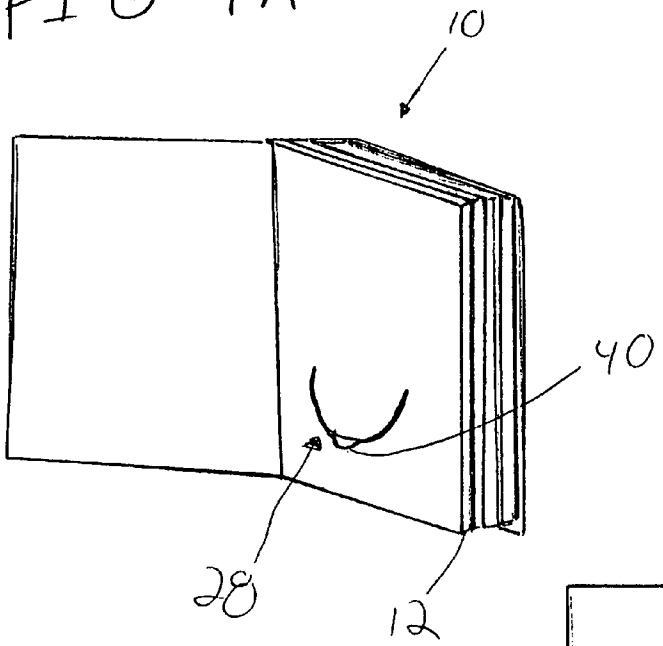
FIG. 1A is a perspective view of a lift-a-flap board book showing the book open and one page with a flap.

Referring now generally to FIGS. 1A–5, a flap board book of the current invention is generally shown and designated by the numeral 10. The flap board book 10 comprises at least one page 12 constructed of a first piece of grayback board 14 and a second piece of grayback board 16. The first piece of grayback board 14 has a front side 18 and a back side 20, while the second piece of grayback board 16 has a front side 22 and a back side 24. The front sides 18 and 22 include a coating 26 adapted to accept printing ink.

The coating 26 can be a type of covering known in the art to completely cover one side of grayback board to condition that side to more readily accept four color printing. In a preferred embodiment, the coating is obtained by bombarding the rough unfinished surface of grayback paper board with clay, or another similar substrate, to smooth the rough unfinished surface and then adding a layer of material to allow printing ink to be applied in a consistent and clear manner. Alternatively, the coating can be applied by laminating a thin sheet of white paper over the rough unbleached grayback board.

The first piece of grayback board 14 includes a rotateably attached section 28, which can also be called a flap 28 or a viewing area 28. The section 28 is positioned to allow viewing of a portion of the backside 20 of the first piece of grayback board 14 and a portion 32 of the backside 24 of the second piece of grayback board 16. Both the portion 30 and the portion 32 include a flashing 34 adapted to accept printing ink. Also included is the notched opening 40 that allows a reader to easily open the flap 28 to view the printed matter 35.

Figure 4:
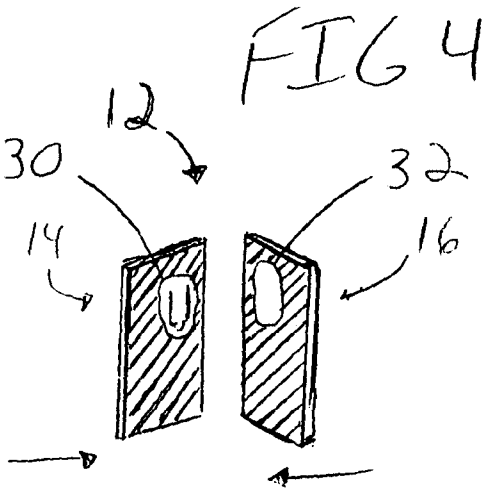
FIG. 4 shows a perspective view of the grayback board pieces from FIGS. 2A–2B and 3A–3B being assembled.
Figure 2B:
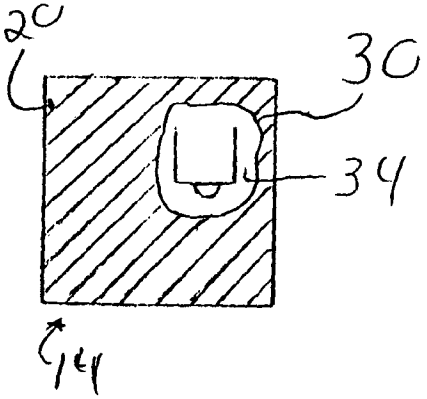
FIG. 2B shows the back portion of the grayback board piece shown in 2A.
Figure 2A:
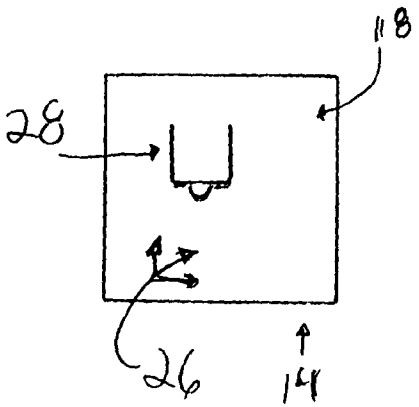
FIG. 2A shows the coated side of a piece of grayback board having a flap positioned or cut into the piece of grayback board.
Figure 3B:
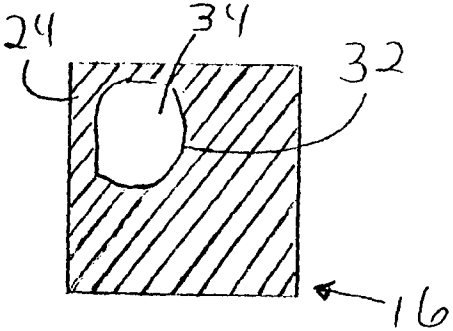
FIG. 3B shows the back of the grayback board shown in FIG. 3A.
Figure 3A:
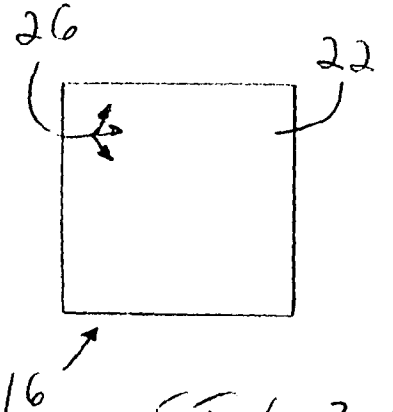
FIG. 3A shows a front side of piece of grayback board.

As seen in FIGS. 2A and 2B, the flap 28 is positioned on the first piece of grayback board 14 to correspond with the flashing 34 of the backside 20. As seen in FIG. 4, when the first piece of grayback board 14 and the second piece of grayback board 16 are assembled, the flap 28 is aligned with the flashing 34 on the backside 24 of the second piece of grayback board 16. This positioning and alignment allows a reader to view the flashing 34, and the printed matter 35 therein, when the flap 28 is raised.

Flashing 34 is a partial covering of one side of a piece of grayback board such that the covering provides a surface that will accept four color printing such that the four color printing will not be substantially obscured or affected by the texture and color of the grayback board. In a preferred embodiment, the flashing 34 includes layering and covering a partial area of the grayback board with white ink to prepare that area for four-color printing. The flashing 34 normally has a curing, or drying, time allows the flash area to properly establish the area for the four-color printing. The flashing 34 can be a white ink used to cover the specific portions 30 and 32 of the flap board book 10. The flashing 34 can be comprised of standard white process ink known in the art, or white silk screen known in the art.

The flap board book 10 includes four color printing, or printed matter in four colors, on the front side 18 and 22 and on the portions 30 and 32. The four-color printing is the standard four-color printing used in the art to make books, magazines, and other items.

The individual page 12 of the lift the flap board book 10 includes the first piece of grayback board 14 adhered to the second piece of grayback board 16. Specifically, the backsides 20 and 24 of the first and second pieces of grayback board 14 and 16 are adhered together. The backsides 20 and 24 piece of the pieces of grayback board 14 and 16 can be described as being partially treated to accept printing ink. The flap 28 can be described as being cut in the first piece of grayback board 14 to allow selective viewing of the partially treated portions 30 and 32.

The flaps 28 includes a perimeter 36 partially separated from the first piece of grayback board 14. The flap 28 also includes a side 38 attached to the first piece of grayback board 14. The flap 28 can be described as being positioned on the first piece of grayback board 14 to expose a portion 30 of the back side 20 of the first piece of grayback board 14. The flap 28 is also positioned to expose a portion 32 of the backside 24 of the second piece of grayback board 16. The flap 28 can be described as being partially cut out of the first piece of grayback board 14 and still hung by one side 38 to the first piece of grayback board 14.

Figure 5:
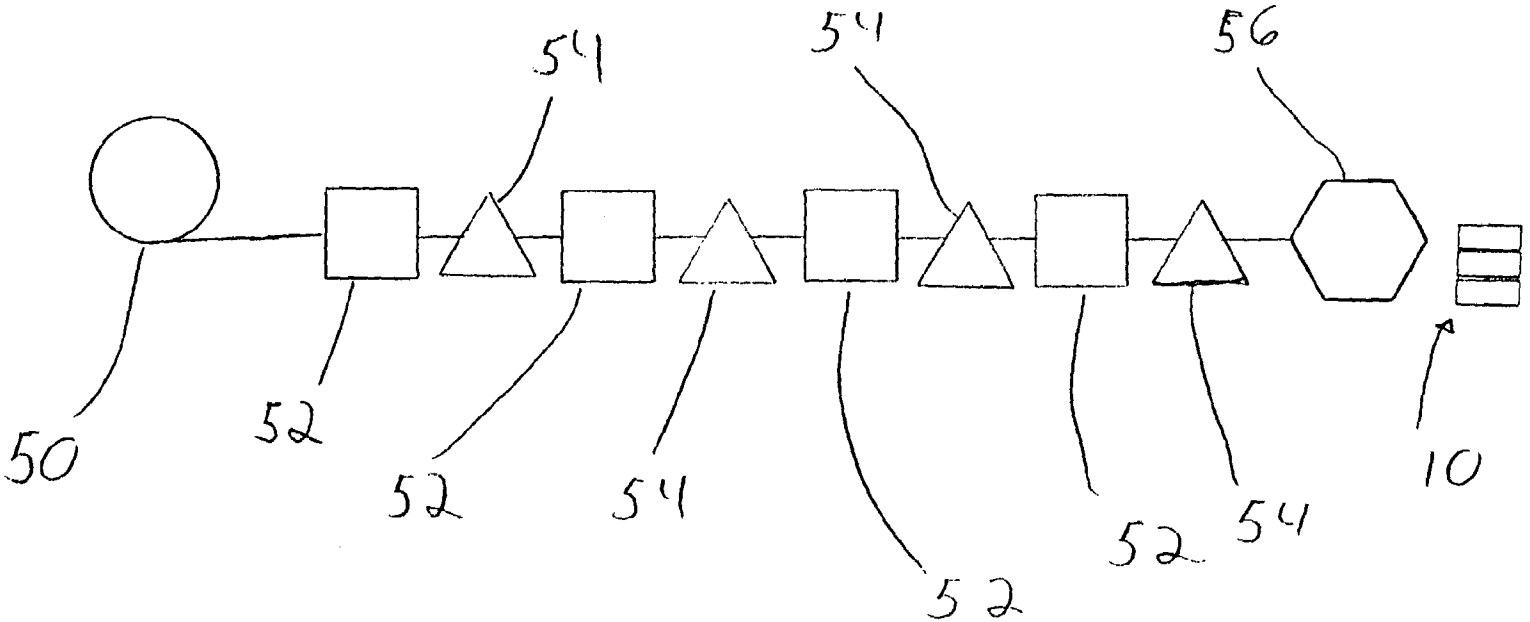
FIG. 5 is a schematic representation of the offset printing process.

FIG. 5 shows a schematic representation of the offset printing process. In this invention, a supply of material 50, is grayback board coated on one side and having a flashing located at a specific location on the other side, proceeds through several offset printing machines 52 and curing machines 54 that properly apply and set the four color printing ink. A processing machine 56 then assembles the material 50 into the finished flap board books 10 after the four color printing ink has been applied.

METHODS

Included herein is a method of creating a page for a lift-a-flap book. The method comprises providing a first piece of grayback board coated on the first side, flashing a portion of a second side of the grayback board, assembling a selective viewing area aligned with the flashed portion of the second side, and applying printed matter to the first side and the flash portion of the second side. The method also includes allowing the flash portion to dry before applying the printed matter. The method further includes applying the printed matter in four directions and allowing the printed matter to dry.

Also included is proving a second piece of grayback board that has been coated on the first side and has a flashed portion on a second side. The second piece of grayback board is attached to the first piece of grayback board. Specifically, the second piece of grayback board is attached to the first piece of grayback board such that the flash portions are aligned. This allows viewing from the selective viewing area of the flashed portions.

In a preferred embodiment, at least two pieces of grayback board that have been coated on one side are used. Normally, printed matter in four colors has been applied to the coated side of each piece of grayback board. This four color printed matter is allowed to dry and then a selective location on the back of each piece of the grayback board is flashed. The flashing is allowed to dry and a four color printing process is applied over the flashed area. One of the grayback board pieces is prepared and cut such that a rotateably attached flap is created. The flap is positioned so as to align with the flashed and four color printed portion on the back of this grayback board piece. Then the two grayback board pieces are aligned such that the rotateably attached flap is aligned with the flashed and printed portion on the backside of the piece of grayback board that does not have the flap. The alignment of these two pieces are best seen in FIG. 4.

In a preferred embodiment, the flashing uses silk screen ink. Only one coating of the silk screen ink is needed due to the thicker and less translucent properties of the silk screen. The silk screening ink is allowed to dry, but due to the quick drying properties of the silk screen ink the four-color printing can follow almost immediately.

In an alternate embodiment standard white process ink is used as the flashing. The standard white process ink is allowed to dry which can take approximately one day. Then a second layer of white processing ink is applied over the same location and allowed to dry which can also take approximately one day.

The four color process used to apply the printed matter is the standard four color process known in the art. This process uses black, cyan, magenta, and yellow to obtain the full spectrum of colors for printed matter.

Thus, although there have been described particular embodiments of the present invention of a new and useful Board Book Construction, it is not intended that such references be construed as limitations upon the scope of this invention except as set forth in the following claims.

What is claimed is:

1. A flap board book comprising:

at least one page constructed of a first piece of grayback board and a second piece of grayback board attached to the first piece of grayback board, each piece of grayback board having a front side and a backside;

each front side including a coating adapted to accept printing ink;

the first piece of grayback board including a rotateably attached section positioned to allowing viewing of a portion of the backside of the first piece of grayback board and a portion of the backside of the second piece of grayback board; and a flashing adapted to accept printing ink positioned only on the portion of the backside of the first piece of grayback board and the portion of the backside of the second piece of grayback board.

2. The flap board book of claim 1, wherein each front side includes printed matter in four colors.

3. The flap board book of claim 2, wherein the portion of the backside of the first piece of grayback board and the portion of the backside of the second piece of grayback board includes printed matter in four colors.

4. The flap board book of claim 1, wherein the backside of the first piece of grayback board is adhered to the backside of the second piece of grayback board.

5. The flap board book of claim 1, wherein the flashing is white.

6. A page of a lift-the-flap board book comprising a first piece of grayback board adhered to a second piece of grayback board, each piece having a backside partially treated to accept printing ink;

a rotateably attached flap cut in the first piece of grayback board to allow selective viewing of the partially treated backsides.

7. The page of claim 6, wherein the flap includes a perimeter partially separated from the first piece of grayback board.

8. The page of claim 6, wherein the flap includes one side attached to the first piece of grayback board.

9. The page of claim 6, wherein the treated portions include printed matter in using a four color process.

10. A flap board book comprising:

at least one page constructed of a first piece of grayback board having a first front side and a first backside;

a second piece of grayback board having a second front side and a second backside, the second piece of grayback board adhered to the first piece of grayback board;

a flap positioned on the first piece of grayback board to expose a portion of the backside of the first piece of grayback board and a portion of the backside of the second piece of grayback board;

wherein each front side includes a coating adapted to accept printing ink;

wherein only the exposed portion of the backside of the first piece of grayback board and the exposed portion of the backside of the second piece of grayback board include a treatment adapted to accept printing ink.

11. The flap board book of claim 10, wherein each front side includes printed matter in four colors.

12. The flap board book of claim 10, wherein the exposed portion of the backside of the first piece of grayback board and exposed the portion of the backside of the second piece of grayback board includes printed matter in four colors.

13. The flap board book of claim 10, wherein the treatment is a layer of ink.

14. The flap board book of claim 13, wherein the layer of ink is white.

15. The flap board book of claim 10, wherein the flap includes one side and is cut out of and still hung by the one side to the first piece of grayback.

16. A method of creating a page for a lift-the-flap book comprising:

a. providing a first piece of grayback board coated on a first side;

b. flashing only a portion of a second side of the grayback board;

c. assembling a selective viewing area aligned with the flashed portion of the second side; and d. applying printed matter to the first side and the flashed portion of the second side.

17. The method of claim 16, wherein step b) includes allowing the flashed portion to dry before proceeding.

18. The method of claim 16, further including step e) of allowing the printed matter to dry.

19. The method of claim 16, wherein step d) includes applying printed matter using a four color process.

20. The method of claim 16, further including attaching a second piece of grayback board that has been coated on a first side and flashed on a portion of a second side.

21. The method of claim 20, further including attaching the second piece of grayback board to the first piece of grayback board such that the flashed portions align.

* * * * *